US008444371B2

(12) United States Patent
John et al.

(10) Patent No.: US 8,444,371 B2
(45) Date of Patent: May 21, 2013

(54) AXIALLY-ORIENTED CELLULAR SEAL STRUCTURE FOR TURBINE SHROUDS AND RELATED METHOD

(75) Inventors: Joshy John, Bangalore (IN); Sanjeev Kumar Jain, Bangalore (IN); Rajnikumar Nandalal Suthar, Bangalore (IN)

(73) Assignee: General Electric Company, Schenectady, NY (US)

( * ) Notice: Subject to any disclaimer, the term of this patent is extended or adjusted under 35 U.S.C. 154(b) by 649 days.

(21) Appl. No.: 12/757,584

(22) Filed: Apr. 9, 2010

(65) Prior Publication Data

US 2011/0248452 A1 Oct. 13, 2011

(51) Int. Cl.
*F01D 5/08* (2006.01)

(52) U.S. Cl.
USPC ..... 415/1; 415/114; 415/173.4; 415/173.5; 415/173.6; 415/174.4; 415/176; 416/192

(58) Field of Classification Search
USPC ..... 415/1, 114, 173.1, 173.4, 173.5, 415/173.6, 174.2, 174.4, 175, 176; 416/192
See application file for complete search history.

(56) References Cited

U.S. PATENT DOCUMENTS

| | | | | |
|---|---|---|---|---|
| 3,529,905 | A * | 9/1970 | Meginnis | 415/176 |
| 3,719,365 | A | 3/1973 | Emmerson et al. | |
| 3,880,435 | A * | 4/1975 | Thornbald | 415/173.1 |
| 3,970,319 | A * | 7/1976 | Carroll et al. | 415/173.4 |
| 4,214,851 | A | 7/1980 | Tuley et al. | |
| 4,468,168 | A * | 8/1984 | Aubert | 415/116 |
| 4,526,509 | A * | 7/1985 | Gay et al. | 415/173.3 |
| 4,540,335 | A * | 9/1985 | Yamaguchi et al. | 415/129 |
| 4,623,298 | A | 11/1986 | Hallinger et al. | |
| 5,197,281 | A | 3/1993 | Pryzytulski et al. | |
| 5,971,710 | A * | 10/1999 | Stauffer et al. | 416/191 |
| 6,913,445 | B1 | 7/2005 | Beddard et al. | |
| 6,962,248 | B2 | 11/2005 | Gordon et al. | |
| 2009/0014964 | A1 | 1/2009 | Pu et al. | |

* cited by examiner

*Primary Examiner* — Igor Kershteyn
(74) *Attorney, Agent, or Firm* — Nixon & Vanderhye, P.C.

(57) ABSTRACT

A seal system between a row of buckets supported on a machine rotor and a surrounding stationary casing or stator includes a tip shroud secured at radially outer tips of each of the buckets, the tip shroud formed with a radially-projecting rail. A cellular seal structure is supported in the stationary stator in radial opposition to the tip shroud and the rail. The seal structure has an annular array of individual cells formed to provide continuous, substantially horizontal flow passages devoid of any radial obstruction along substantially an entire axial length dimension of the cellular seal structure to prevent flow about the tip shroud from turning radially inwardly.

20 Claims, 6 Drawing Sheets

AXIALLY-ORIENTED CELLULAR SEAL STRUCTURE FOR TURBINE SHROUDS AND RELATED METHOD

BACKGROUND OF THE INVENTION

This present invention relates generally to turbines and turbine blades and more particularly, to tip-shrouded turbine blades and associated cellular seal structures.

An axial gas turbine stage consists of a row of stationary blades followed by a row of rotating blades or buckets in an annulus defined by the turbine casing or stator. The flow is partially expanded in the vanes which direct the flow to the rotating blades where it is further expanded to generate required power output. For safe mechanical operation, there exists a minimum physical clearance requirement between the tip of the rotating blade and the casing or stator wall. Honeycomb strips on the casing wall are generally used to minimize running tip clearance of the rotating bucket at all operating conditions. To achieve tighter clearance, a rail on the tip shroud is allowed to rub and cut a groove in the honeycomb strip during transient operations. The shape and depth of this groove depends on the rotor dynamics and thermal behavior, i.e., differential radial and axial thermal expansion of the rotor and casing.

The high energy flow escaping over the bucket tips and its subsequent interaction with the downstream main flow is one of the major sources of loss in the turbine stage. Typically, these tip clearance losses in turbines constitute 20 to 25 percent of the total losses within a given stage. Due to the inherent shape of the groove cut in the honeycomb seal structure, the overtip leakage flow turns downward (i.e., radially inward) and penetrates deep into the main flow path causing excessive mixing losses. Accordingly, any design which minimizes this mixing loss will improve the turbine stage efficiency. In addition, the turning inward of high temperature, overtip leakage flow due to the groove shape and honeycomb seal configuration, causes the tip leakage flow to touch the aft side of the bucket tip shroud, exposing it to a relatively hotter operating environment compared to a non-grooved seal configuration. Since the bucket shroud is one of the life-limiting components of the turbine machine, any design which reduces shroud temperature will enhance bucket life.

SUMMARY OF THE INVENTION

In accordance with an exemplary but nonlimiting embodiment, the invention provides a seal system between a row of buckets supported on a machine rotor and a surrounding stationary casing comprising: a tip shroud secured at radially outer tips of each of the buckets, the tip shroud formed with a radially-projecting rail; and a cellular seal structure supported in the stationary casing in radial opposition to the tip shroud and the rail, the seal structure having an annular array of individual cells formed to provide continuous, substantially horizontal flow passages devoid of any radial obstruction along substantially an entire axial length dimension of the cellular seal structure.

In another exemplary but nonlimiting aspect, the invention provides a seal system between a row of buckets supported on a machine rotor and a surrounding stationary casing comprising: a tip shroud secured at radially outer tips of each of the buckets, the tip shroud formed with a radially-projecting rail; a cellular seal structure supported in the stationary casing in radial opposition to the tip shroud and the rail, the seal structure having an annular array of individual cells formed to provide substantially horizontal, closed-periphery flow passages extending continuously between forward and aft ends of the seal structure, the individual cells oriented substantially parallel to a rotation axis of the rotor, plus or minus 45 degrees.

In still another exemplary but nonlimiting aspect, the invention provides a method of reducing mixing losses caused by tip leakage flow at a bucket tip/shroud-stator seal interface mixing with a main flow of combustion gases in a turbine engine, the method comprising: providing a cellular seal structure in a stator surface surrounding an annular bucket tip shroud; providing a rail on the radially outer surface of the bucket tip shroud adapted to penetrate the cellular seal structure during transient operating conditions of the turbine engine due to differential thermal expansion properties of the rotor and stator; and forming the cellular seal structure to include an annular array of individual cells arranged to provide substantially horizontal, closed-periphery flow passages extending continuously and unobstructed between forward and aft ends of the seal structure so that, upon penetration of the seal structure by the rail, tip leakage flow around the tip shroud will be confined to the substantially horizontal, closed-periphery flow passages and thus be prevented from turning radially inwardly into the main flow along an entire axial length dimension of the seal structure.

The invention will now be described in detail in connection with the drawing figures identified below.

DETAILED DESCRIPTION OF THE INVENTION

Figure 1:
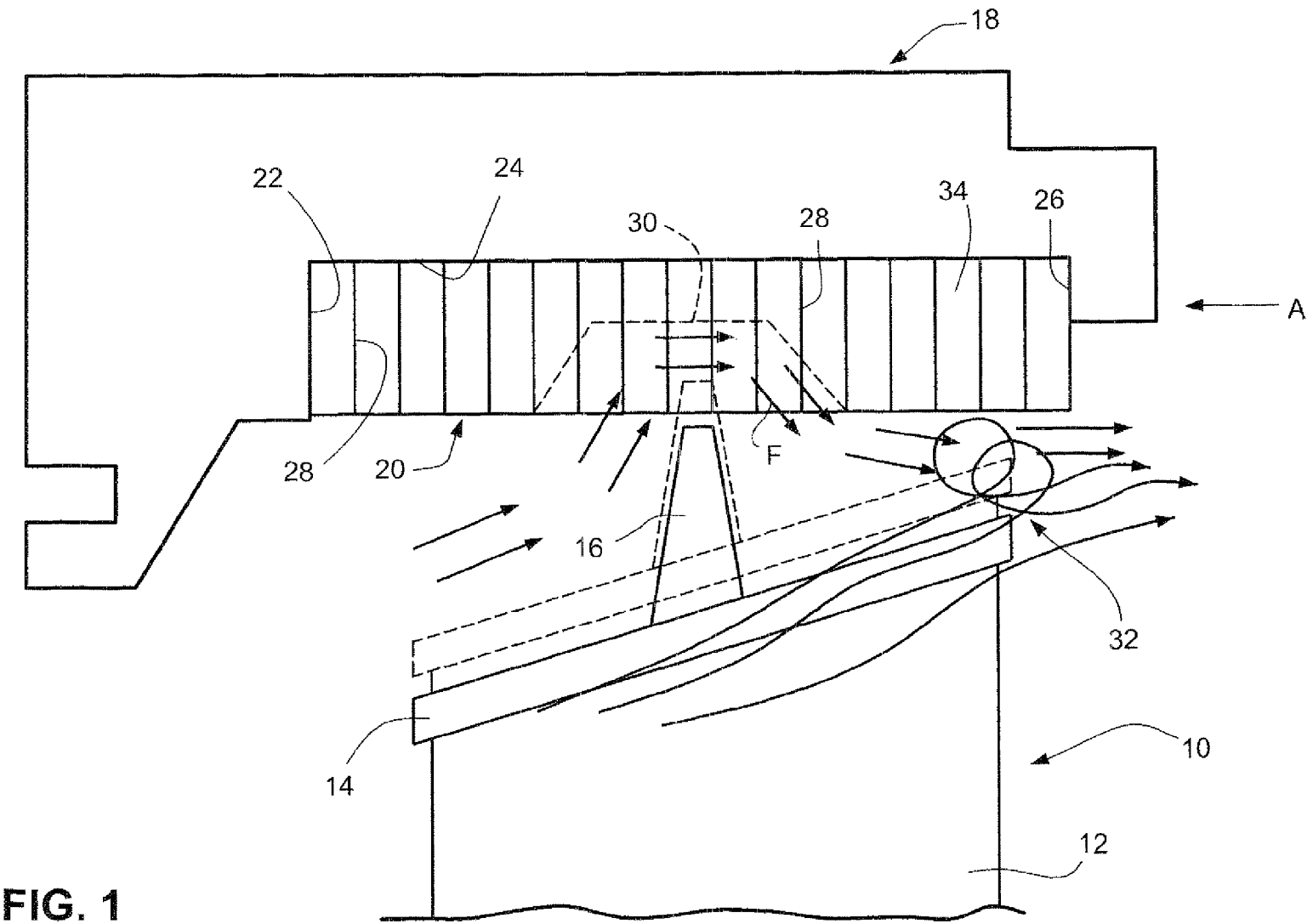
FIG. 1 is a schematic side elevation illustrating a tip shrouded bucket and a known honeycomb seal structure on the surrounding stationary shroud.

Referring now to FIG. 1, a typical tip-shrouded turbine bucket 10 includes an airfoil 12 which is the active component that intercepts the flow of gases and converts the energy of the gases into tangential motion. This motion, in turn, rotates the rotor to which the buckets 10 are attached.

A shroud 14 (also referred to herein as a "tip shroud") is positioned at the tip of each airfoil 12 and includes a plate supported toward its center by the airfoil 12. The tip shroud may have various shapes as understood by those skilled in the art, and the exemplary tip shroud as illustrated here is not to be considered limiting. Positioned along the top of the tip shroud 14 is a seal rail 16 which minimizes passage of flow path gases through the gap between the tip shroud and the inner surface of the surrounding components. The rail 16 typically provided with a cutting tooth (not shown) for a purpose described below.

As shown in FIG. 1, the surrounding stationary stator shroud 18 mounts a honeycomb seal structure 20 confined within a recessed portion of the stationary shroud as defined by wall surfaces 22, 24 and 26.

Operating at transient conditions (e.g., during start-up, during significant load changes, and during shut-down), and prior to reaching a state of thermal equilibrium among the turbine hot gas path components, different axial and radial thermal expansion properties of the buckets or blades 10 relative to the stator will cause the rail 16 and its cutting tooth to cut through the honeycomb seal structure 20, forming a substantially C-shaped groove 30. Because the honeycomb seal structure is formed at least in part by radially-extending wall surfaces 28 that extend radially and substantially transverse to the rotor axis, the combustion gas leakage flow crossing over the rail 16 turns radially inwardly to the main flow passage (as shown by the flow arrows F) as it enters and exits the groove 30 cut through the honeycomb seal structure. This inward turning causes the leakage flow and the main flow to interact in the area designated 32, thus creating a relatively large mixing loss.

To more fully understand this phenomenon, the construction of the honeycomb seal structure 20 includes, in addition to the annular (or part-annular) radially-extending, axially-spaced walls 28, plural axially-extending, circumferentially-spaced walls that combine with the walls 28 to form individual cells. The shape and arrangement of the walls 28 and 34 may vary but in all cases, it is the presence of axially-spaced, radially-extending annular or part-annular wall portions 28 in the individual cells, that are substantially transverse to the rotor axis, that force the tip leakage flow about the rail 16 to turn radially inwardly to interact with the main flow as previously described.

Figures 2, 2A:
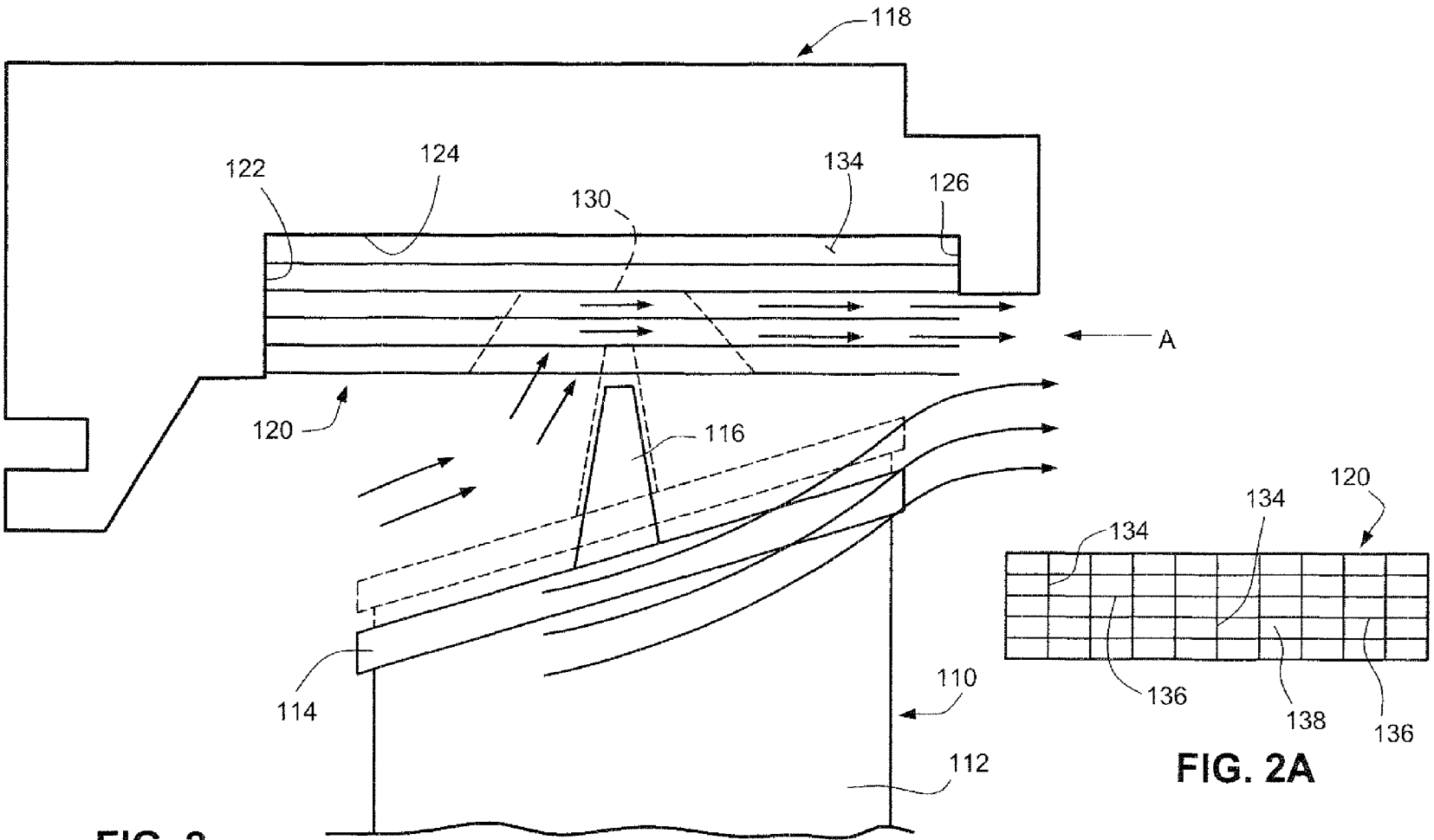
FIG. 2 is a schematic side elevation similar to FIG. 1 but incorporating a cellular seal structure in accordance with a first exemplary but nonlimiting embodiment of the invention.
FIG. 2A is a schematic flat projection of the cellular seal structure of FIG. 2 as viewed in the direction of arrow A in FIG. 2.

With reference now to FIG. 2, an exemplary but nonlimiting embodiment of the present invention is illustrated. For convenience, reference numerals as used in FIG. 1, but with a prefix "1" added, are used in FIG. 2 to indicate corresponding components. The difference lies in the construction of the cellular structure 120. Initially, it is noted that in the prior arrangement described above, the seal structure is properly characterized as a "honeycomb" configuration. As will become apparent below, however, the seal structure need not be of honeycomb configuration and, in fact, may take on any number of cellular configurations so long as certain criteria are met as explained below.

More specifically, the honeycomb structure 20 of FIG. 1 has been discarded in favor of a cellular seal structure 120 as shown in FIG. 2, located in the recessed portion of the shroud as defined by walls 122, 124 and 126. Of significance to the modified design is the absence of any axially-spaced, radially-inwardly extending annular or part-annular walls that are substantially transverse to the rotor axis, and that would otherwise obstruct and turn radially inwardly the tip leakage flow. FIG. 2A is a schematic reference view of the new cellular (or cell) structure 120 as viewed in the direction of arrow A in FIG. 2. It will be understood that the structure is shown in a flat projection but, in fact, has an arcuate cross-section, the arcuate length of which is determined by the arcuate length of the stator segment supporting the seal. The cellular structure 120 is comprised of circumferentially-spaced, axially-extending, radial partitions 134 and plural, substantially concentric, radially spaced and axially-extending annular walls 136. The combination of walls 134 and 136 create individual cells or passages 138 that extend in a substantially horizontal, (or axial) direction continuously along the cellular seal structure 120, without obstruction, from one end of the seal structure at wall 122 to the opposite end of the seal structure indicated at wall 126. This means that when the groove 130 is cut into the cellular structure 120 by the rail 116 (and, specifically, the rail's cutting tooth, not shown), the tip leakage flow, once it crosses over the bucket tip rail 116, will flow in an axial direction without obstruction and with the concentric, radially-spaced walls 136 preventing the tip leakage flow from turning radially into the main flow, hence avoiding or at least minimizing the previously-described mixing losses.

Figure 3:
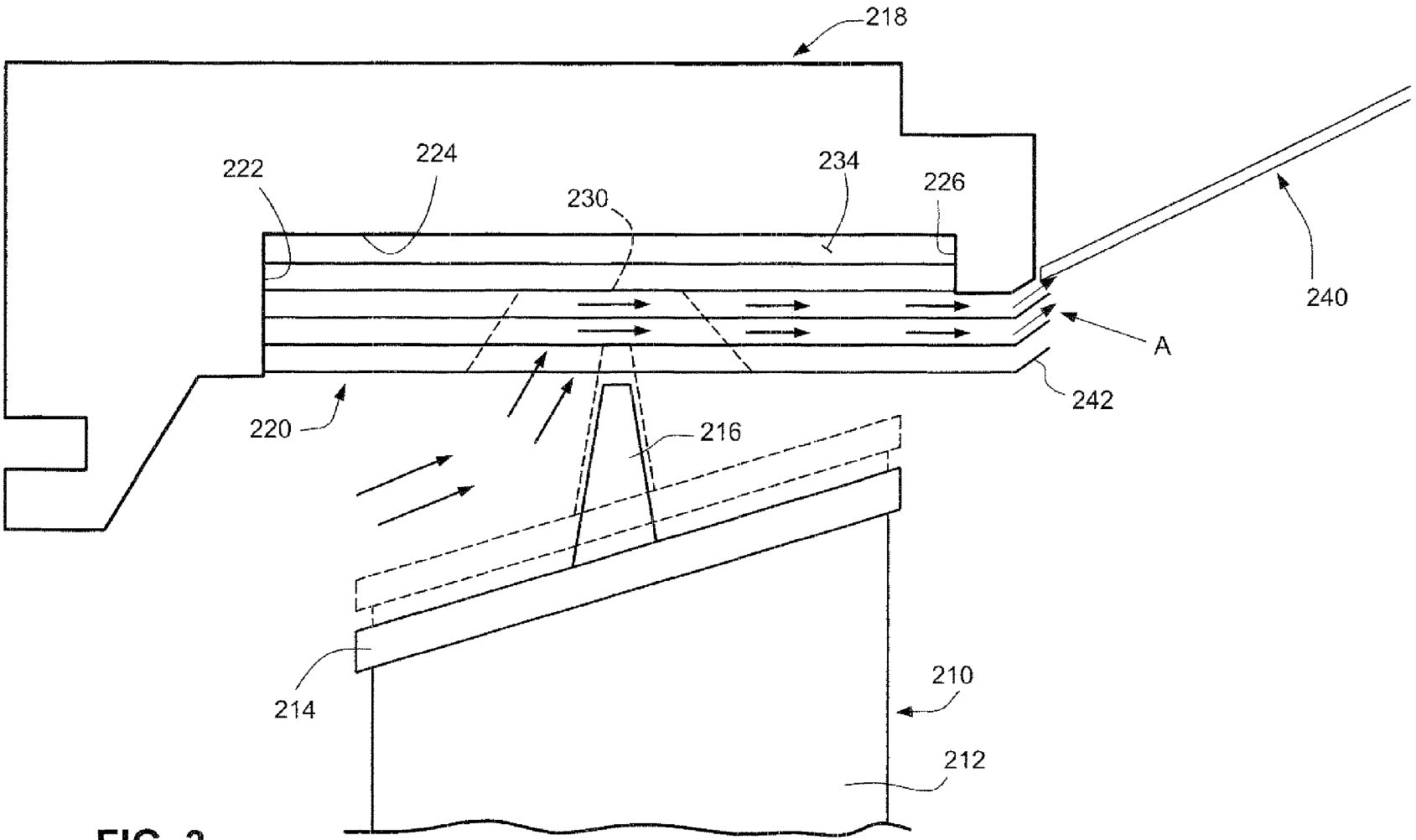
FIG. 3 is a schematic side elevation similar to FIG. 2 but showing an alternative cellular seal structure having an exit end aligned with a downstream diffuser component.
Figure 4:
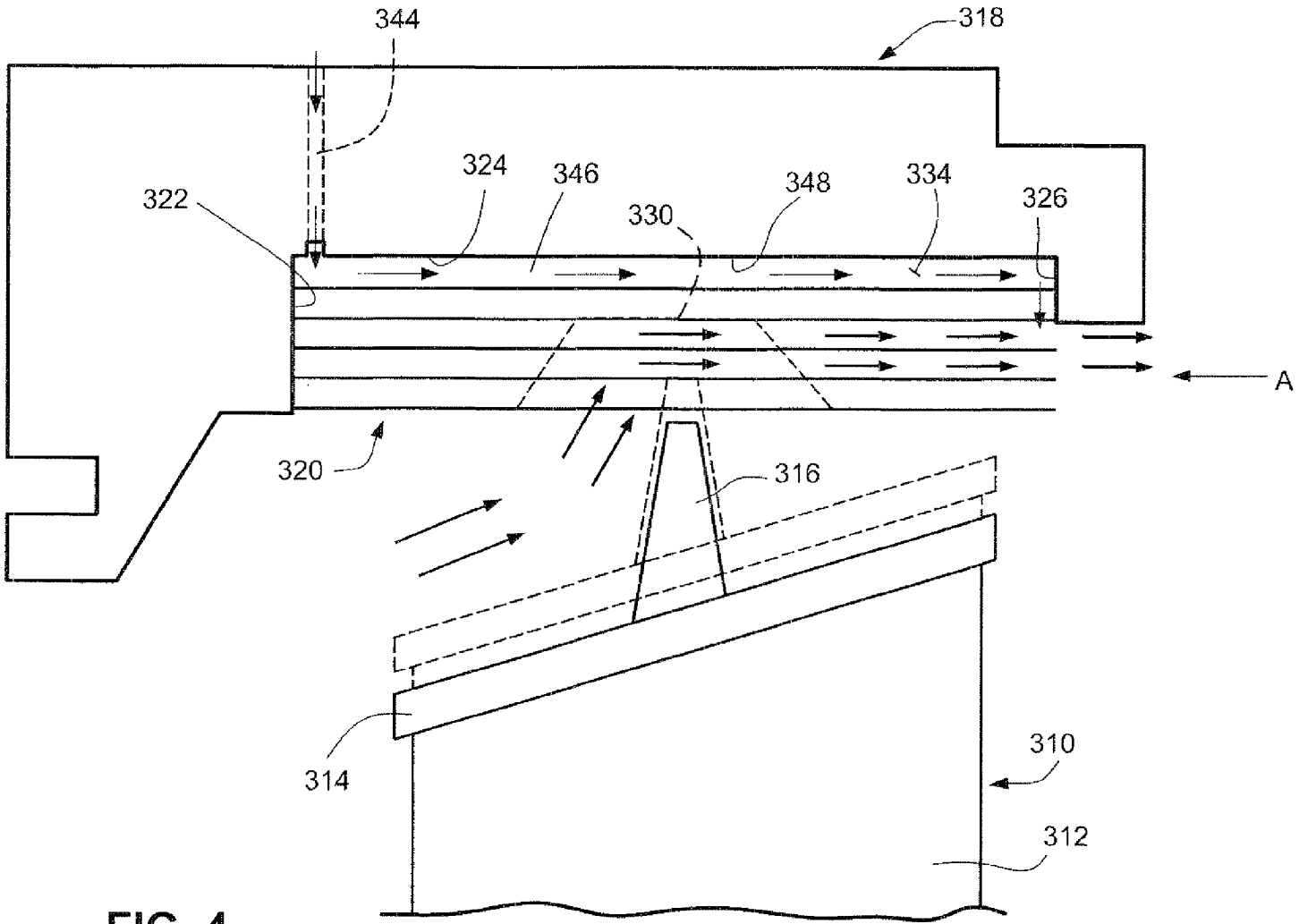
FIG. 4 is a schematic side elevation similar to FIG. 2 but illustrating a variation where coolant is supplied to the seal structure in accordance with another exemplary embodiment of the invention.

Additional benefits of the above-described cellular structure are illustrated in FIGS. 3 and 4. In FIG. 3, similar reference numerals but with the prefix "2", are used to designate corresponding components where applicable. Thus, the cellular structure 220 is located in a recessed portion of the shroud and as defined by walls 222, 224 and 226. For a last stage row of buckets, the high energy tip leakage flow can be aligned with an exhaust diffuser 240 by altering the exit angle of the cell walls 242 at the downstream end of the cell structure 220 (and downstream of the aft edge of the bucket) to align the tip leakage flow with the angle of the exhaust diffuser, and thereby attach the flow to the diffuser. This can improve the performance of the diffuser apart from improving the stage performance mixing loss reduction.

FIG. 4 illustrates yet another advantage of the axially-oriented cell structure in that it provides relatively better insulation for the stationary shroud or stator from the hot gas path. This may also be utilized as an improved cooling circuit for the stationary shroud. Here again, similar reference numerals as applied in FIGS. 2 and 3, but with the prefix "3", are used to indicate corresponding components, again where applicable. Here, the cellular seal structure 320 is located in a recessed portion of the shroud formed by walls 322, 324 and 326. More specifically a coolant flow conduit 344 and suitable supply means are used to supply coolant to the passage 324 in the cellular structure 320, closest to the stator wall 348, thus cooling the stator or shroud wall 324, by convection. The cooling air then joins with the main flow in a smooth transition, with little or no disruptive mixing.

FIGS. 5-10 illustrate exemplary but nonlimiting alternative cell configurations within the scope of the present invention. These alternative cell constructions are viewed from the same perspective as FIG. 2A. In each case, an array of unobstructed, axially-oriented cells are created by the internal structure to cause tip leakage flow to remain in a substantially axial or horizontal orientation, so as to be prevented from turning radially inward into the main flow. Thus, in FIG. 5, a combination of alternating "corrugated" walls 410 and radially-spaced, annular concentric walls 412 create a plurality of triangular cells 414 extending continuously without obstruction in the axial or horizontal direction between the radial walls 122 and 126 of the stationary shroud 118 (FIG. 2).

Figure 5:
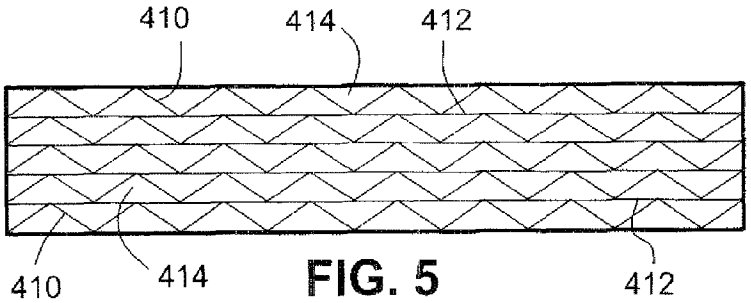
FIGS. 5-9 represent schematic flat projections of cellular structures within the scope of the invention and taken from the same perspective as FIG. 2A.
Figure 6:
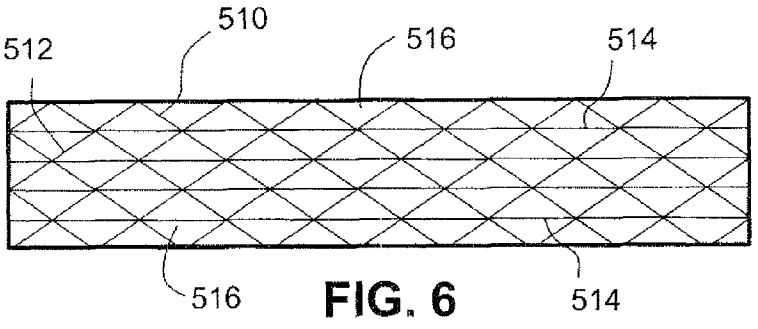

In the cellular structure shown in FIG. 6, alternating corrugated walls 510, 512 are inverted relative to each other so that, when combined with the radially-spaced, annular concentric walls 514 the triangular cells 516 are substantially identical to those formed in the FIG. 5 construction, but the cells are aligned differently with the cells in adjacent rows.

Figure 7:
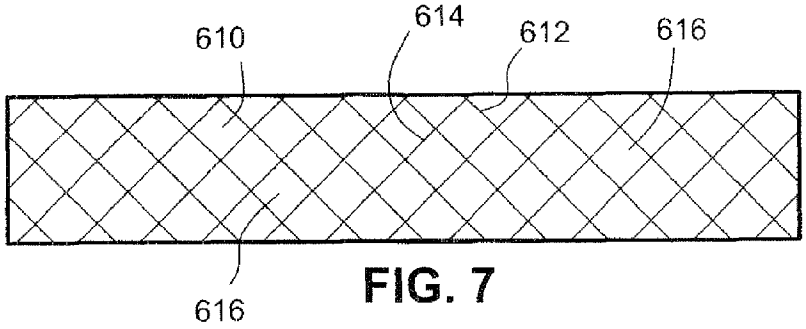

FIG. 7 illustrates another example embodiment where the individual cells 610 are created by an array of oppositely-oriented, angled (or criss-crossed) walls 612, 614 creating axially- or horizontally-extending diamond-shaped cells 616 (but modified along the margins as shown).

Figure 8:
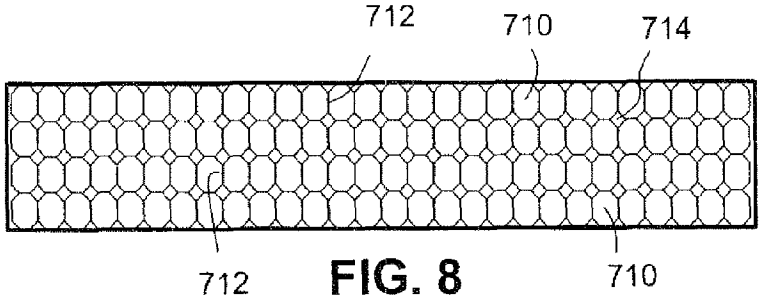

In FIG. 8, the cells 710 are created by an array of axially- or horizontally-extending tubes 712, each of which has a polygonal shape and which are engaged by like tubes in both circumferential and radial directions.

Figure 9:
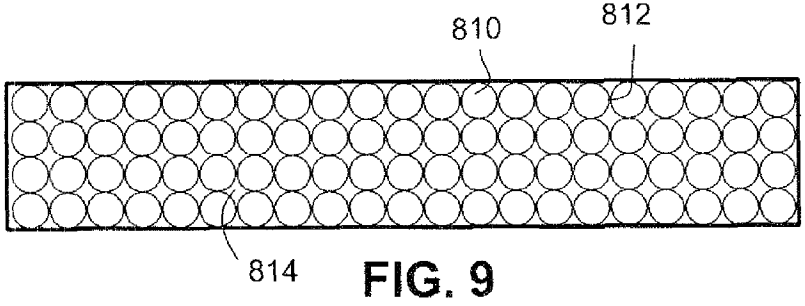

FIG. 9 illustrates a construction generally similar to that shown in FIG. 8 but wherein the cells 810 are circular in shape as defined by the array of circular tubes 812 which, again, are engaged both circumferentially and radially. Note that in both embodiments illustrated in FIGS. 8 and 9, additional axial cells are created at 714, 814, respectively, at the interstices between the tubes 712, 812.

Other cell constructions are contemplated by the invention, the significant design feature being the creation of axially-extending, unobstructed cells to cause the tip leakage flow to remain in a substantially axial direction, so as to prevent radially inward turning and subsequent mixing of the tip leakage flow with the main combustion gas flow. In this regard, the individual cells in any given cellular structure need not be of uniform size and shape, so long as the design feature mentioned above is satisfied.

Figure 12:
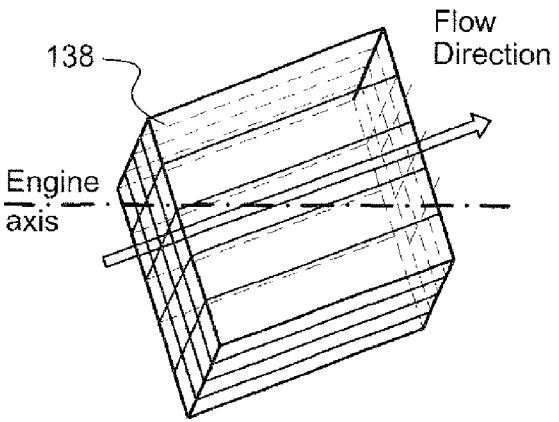
FIGS. 10-12 represent schematic representations of the cellular structures at different axial orientations to the rotor axis.
Figure 11:
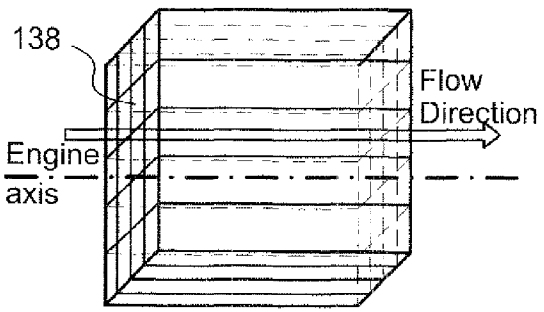
Figure 10:
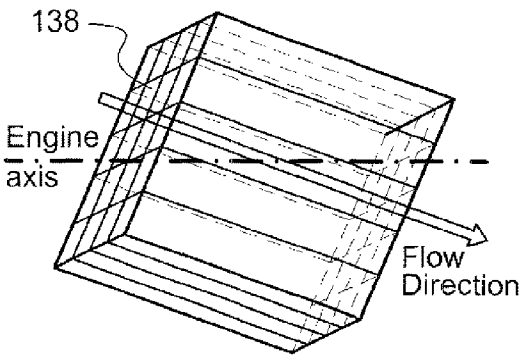

To this point, the various cell constructions have been shown to extend substantially parallel to the rotation axis of the rotor. However, as shown in FIGS. 10, 11, and 12, the cell arrays (using cells 138 as an example) may be slanted in an axial direction at an angle to one side of the rotor axis to an angle of about −45° (FIG. 10), parallel to the rotor axis (FIG. 11) or slanted to the opposite side (FIG. 12), and angle of to about +45°. The orientation will depend on the direction of the main combustion gas flow. By aligning the tip leakage flow with the main gas flow, it is expected that an even further decrease in air mixing losses will be achieved.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

We claim:

1. A seal system between a row of buckets supported on a machine rotor and a surrounding stationary casing comprising:

a tip shroud secured at radially outer tips of each of the buckets, said tip shroud formed with a radially-projecting rail;

a cellular seal structure supported in said stationary casing in radial opposition to said tip shroud and said radially-projecting rail; said radially-projecting rail, in use, adapted to cut a groove in said cellular seal structure, said cellular seal structure having an annular array of individual cells formed to provide continuous, substantially horizontal flow passages devoid of any radial obstruction along substantially an entire axial length dimension of said cellular seal structure, such that gases leaking over said radially-projecting rail will flow along said substantially-horizontal flow passages.

2. The seal system of claim 1 wherein each of said cells extends substantially parallel to a rotation axis of said rotor.

3. The seal system of claim 1 wherein each of said cells extends axially in a range between plus and minus 45 degrees relative to a rotation axis of said rotor.

4. The seal system of claim 1 wherein said annular array of individual cells is formed by plural, substantially concentric, radially-spaced and axially-extending, annular walls intersected by plural, circumferentially-spaced, radially extending partitions.

5. The seal system of claim 1 wherein said annular array of individual cells is formed by plural, radially-stacked, alternating, corrugated and smooth annular sheets.

6. The seal system of claim 1 wherein said annular array of individual cells is formed by plural walls intersecting at substantially 45 degree angles, such that said individual cells are substantially diamond-shaped in cross section.

7. The seal system of claim 1 wherein said annular array of individual cells is formed by an annular, radially-stacked array of axially-extending tubes engaged with adjacent tubes to thereby create a first group of said flow passages within said tubes and a second group of said flow passages in interstices between engaged adjacent tubes.

8. The seal system of claim 1 further comprising means for supplying coolant to at least a radially outer one of said flow passages adjacent a wall of said stationary casing to thereby cool said wall by convection cooling.

9. The seal system of claim 1 wherein at least some cell wall portions downstream of said bucket are angled radially outwardly to substantially align with a surface of a machine component extending in a downstream direction.

10. The seal system of claim 9 wherein said machine component comprises a turbine diffuser.

11. A seal system between a row of buckets supported on a machine rotor and a surrounding stationary casing comprising:

a tip shroud secured at radially outer tips of each of the buckets, said tip shroud formed with a radially-projecting rail;

a cellular seal structure supported in said stationary casing in radial opposition to said tip shroud and said radially-projecting rail; said radially-projecting rail, in use, adapted to cut a groove in said cellular seal structure, said cellular seal structure having an annular array of individual cells formed to provide substantially horizontal, closed-periphery flow passages extending continuously between forward and aft ends of said seal structure, said individual cells oriented substantially parallel to a rotation axis of said rotor, plus or minus 45 degrees, such that gases leaking over said radially-projecting rail will flow along said substantially-horizontal flow passages.

12. The seal system of claim 11 wherein said seal structure is at least partially located within an annular recess formed in said stationary casing, said recess formed by forward and aft radial shoulders connected by an offset axial surface.

13. The seal system of claim 12 wherein means are provided for supplying coolant to at least a radially outer one of said flow passages adjacent said offset axial surface to thereby cool said offset axial surface by convection cooling.

14. The seal system of claim 12 wherein at least some cell wall portions downstream of said aft radial shoulder are angled radially outwardly to substantially align with a surface of a diffuser component extending in a downstream direction.

15. The seal system of claim 11 wherein at least some cell wall portions downstream of said aft radial shoulder are angled radially outwardly to substantially align with a surface of a diffuser component extending in a downstream direction.

16. A method of reducing mixing losses caused by tip leakage flow at a bucket tip/shroud-stator seal interface mixing with a main flow of combustion gases in a turbine engine, the method comprising:

a. providing a cellular seal structure in a stator surface surrounding an annular bucket tip shroud;

b. providing a rail on the radially outer surface of the bucket tip shroud adapted to penetrate the cellular seal structure during transient operating conditions of the turbine engine due to differential thermal expansion properties of the rotor and stator; and c. forming the cellular seal structure to include an annular array of individual cells arranged to provide substantially horizontal, closed-periphery flow passages extending continuously and unobstructed between forward and aft ends of said seal structure so that, upon penetration of said seal structure by said rail, tip leakage flow around said tip shroud will be confined to said substantially horizontal, closed-periphery flow passages and thus be prevented from turning radially inwardly into the main flow along an entire axial length dimension of said seal structure.

17. The method of claim 16 wherein each of said individual cells is formed to extend substantially parallel to a rotation axis of said rotor.

18. The method of claim 16 wherein each of said individual cells is formed to extend axially in a range between plus and minus 45 degrees relative to a rotation axis of said rotor.

19. The method of claim 16 wherein at least some cell wall portions downstream of said bucket are angled radially outwardly to substantially align with a surface of a machine component extending in a downstream direction.

20. The method of claim 16 including supplying coolant to at least a radially outer one of said flow passages adjacent a wall of said stationary casing to thereby cool said wall by convection cooling.

* * * * *